United States Patent [19]

Pieper et al.

[11] 3,957,070

[45] May 18, 1976

[54] UMBRELLA

[75] Inventors: Josef Pieper; Ursula Pieper nee Piseberg, both of Wuppertal, Germany

[73] Assignee: Bremshey Aktiengesellschaft, Solingen, Germany

[22] Filed: Jan. 9, 1975

[21] Appl. No.: 539,810

[30] Foreign Application Priority Data

Jan. 10, 1974 Germany ..... 2401067

[52] U.S. Cl. ..... 135/33 R; 135/26

[51] Int. Cl.[2] ..... A45B 25/18

[58] Field of Search ..... 135/33 R, 26, 20 R, 135/25 R, 25 A

[56] References Cited

UNITED STATES PATENTS

| | | | |
|---|---|---|---|
| 284,771 | 11/1876 | Folsom | 135/33 R |
| 2,258,196 | 10/1941 | Siers | 135/26 |
| 3,693,643 | 9/1972 | Weber | 135/26 |
| 3,804,105 | 4/1974 | Yano | 135/26 |
| 3,826,272 | 7/1974 | Okuda | 135/20 R |
| 3,841,343 | 10/1974 | Seitel | 135/20 R |
| 3,844,302 | 10/1974 | Klein | 135/26 |

*Primary Examiner*—Werner H. Schroeder
*Assistant Examiner*—Conrad L. Berman
*Attorney, Agent, or Firm*—Robert E. Mitchell; Alan Swabey

[57] ABSTRACT

An umbrella including a shortenable frame having dome ribs and a crown at the end of a stick. A cover is supported by the dome ribs and is attached to the crown and peripherally to the ends of the dome ribs. The cover is also attached to the dome ribs at intermediate points between the ends of the dome ribs and the crown. The cover includes a plurality of radially extending stiffened areas including a flexible hinge area at a position such that each radially extending stiffened portion is separated into at least two radially aligned portions whereby the cover material can fold therebetween. The full extent of the radially extending stiffened areas is provided on the portion of the cover between the crown and the intermediate attachment points.

5 Claims, 6 Drawing Figures x
8
7
6
A
I
II
1
2
9
9'
16
13
12
4
14
17
9''
11
3
10
15
5
x

8
P
I
13
6
16
II
19
12
17
11
9
2
9'
14
10
15
5

UMBRELLA

BACKGROUND OF THE INVENTION

1. Field of the Invention

The present invention relates to an umbrella, and more particularly, to an improvement in collapsible umbrellas having a telescopic stick.

2. Description of the Prior Art

In conventional umbrellas of the type using telescopic dome ribs to support the cover as well as of the type wherein the dome rib is not hinged to the crown of the stick but is controlled and supported by a quadrilateral support structure, the cover cannot be neatly and efficiently folded when the stick in the dome rib structure is being collapsed. In an umbrella, the cover is usually attached centrally thereof to the crown and peripherally thereof to each end of the dome ribs. Furthermore, the cover is attached at intermediate points between the ends of the dome ribs and the crown to the geats hinged to the support structure. The portion of the cover extending between the crown and the geats is non-supported when the umbrella is being collapsed and will usually tend to bunch, and a separate manual operation is required to neatly fold this portion of the material into a mushroom shape before the umbrella can be inserted into a sheath.

In an umbrella comprising telescoping ribs, the folds of the cover are easily pinched between the geats and the cover which can give rise to accidental tearing of the fabric making up the cover. With the type of umbrella having a quadrilateral support structure, the fabric is normally pulled into the area between the folding quadrilateral structure and the stick. If the cover is wet, the fabric which is folded will not have an opportunity to dry properly before it is placed in the sheath.

U.S. Pat. No. 3,693,643, issued Sept. 26, 1972, Heinz Weber, inventor, describes a frame having a spreader means attached to the crown thereof adapted to engage the inner portion of a cover to push it outwardly and form a mushroom and thereby overcome the disadvantages mentioned above. However, the frame must be modified and thus the cost of producing the frame will be increased.

SUMMARY OF THE INVENTION

It is an aim of the present invention to provide an umbrella cover whereby when the umbrella is being collapsed, the cover material between its attachment with the geats on the frame and the crown will assume a spread mushroom shape which can be easily folded against the umbrella for insertion into an umbrella sheath.

It is a further aim of the present invention to provide a simple and inexpensive spreader device which can be utilized with a conventional umbrella frame.

A construction in accordance with the present invention includes an umbrella having a frame, a telescopic stick, a crown at one end of the stick, dome ribs extending about the crown and supported on a support structure, a cover supported on the dome ribs and attached centrally to the crown peripherally to each end of the dome ribs and at intermediate points between the ends of the dome ribs and the crown, the cover including a flexible material with stiffened areas between the crown and the intermediate point, the radially extending stiffened areas each having a hinged portion separating the stiffened portions into a first stiffened section and a second stiffened section in radial alignment such that when the umbrella is being collapsed, the second stiffened portions will fold under the first stiffened portions whereby the cover portion between the intermediate points and the crown will form a spread foldable mushroom shape.

BRIEF DESCRIPTION OF THE DRAWINGS

Having thus generally described the nature of the invention, reference will now be made to the accompanying drawings showing by way of illustration a preferred embodiment thereof, and in which.

DESCRIPTION OF THE PREFERRED EMBODIMENT

Figure 1:
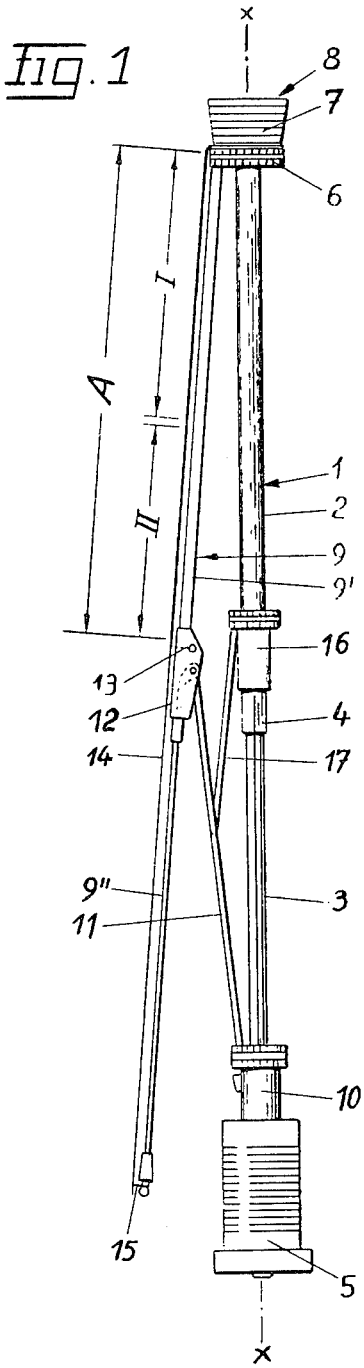
FIG. 1 is a fragmentary view showing an umbrella frame in an extended position with the dome ribs folded down, and a schematic representation of the cover.
Figure 2:
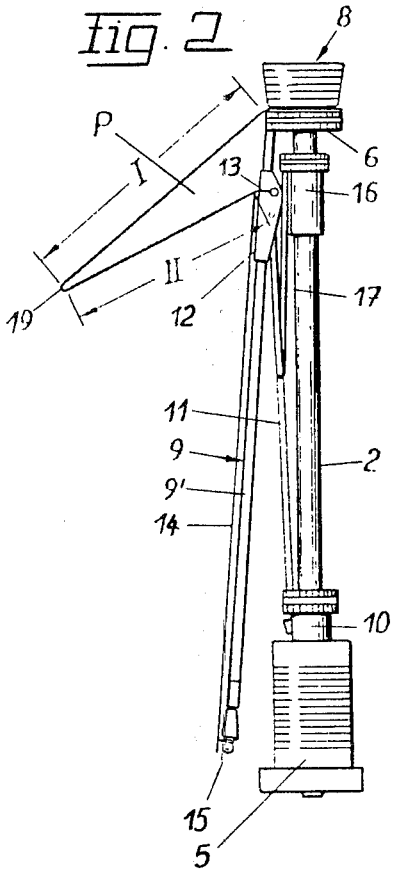
FIG. 2 is a fragmentary elevation of the umbrella shown in FIG. 1 but with the umbrella in a collapsed position and the umbrella cover being shown schematically in a folded mushroom shape.

Referring now to FIGS. 1 and 2, an umbrella of the telescopic type is shown having a stick 1 including a stick section 2 adapted to receive a polygonal tubular stick section 3 in a socket 4 of similar cross-section.

A crown 6 is shown at one end of the stick, and a cap 8 is shown axially adjacent the crown 6. Dome ribs 9 are hinged about the periphery of the crown 6. Each dome rib 9 includes a U-shaped inner section 9' and an outer section 9'' adapted to telescope within the dome rib section 9'. A geats 12 is slidable on the dome rib section 9'. A main runner 10 is slidable on the stick 1, and a stretcher member 11 is hinged to the main runner 10 and to the geats 12. A strut 17 is hinged to an auxiliary runner 16 slidable on the stick between the main runner and the crown. The other end of the strut 17 is hinged to a point on the stretcher member 11 intermediate the geats 12 and the main runner 10.

A cover 14 is attached to the dome ribs such that the center of the cover is fastened between the cap 8 and the crown 6 while peripheral points of the outer rim of the cover are attached to the dome rib tips by means of threads 15. Intermediate points of the cover are anchored to the geats 12 by means of thread 13 which passes through an aperture in the geats 12, as shown in FIGS. 1 and 2.

Figure 3:
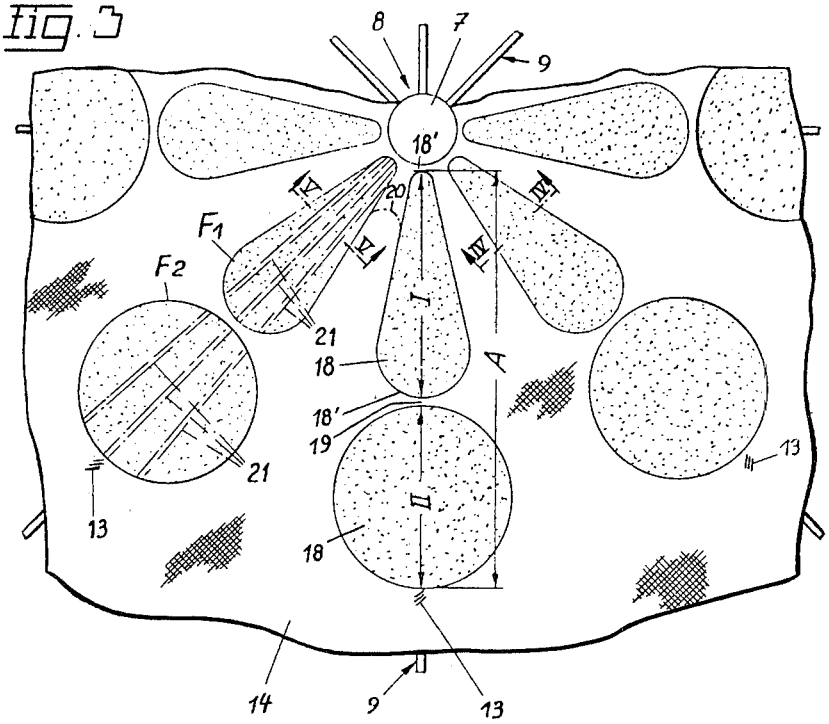
FIG. 3 is a fragmentary top plan view of the umbrella cover.

The annular area of the cover between the intermediate points attached at thread 13 and the crown is designated for purposes of the description by the letter A. Stiffened areas 18 extend radially in pairs from the crown 7. Each pair of stiffened areas includes a somewhat pear-shaped area with rounded ends 18' and having a length I. The other stiffened area of the pair 18 is shown in the embodiment of FIG. 3 as being circular and has a diameter II. The two stiffened areas are separated by an unstiffened portion or gap 19 allowing a hinged area between the pair of stiffened areas 18. The radial sum of the dimensions of stiffened areas 18 and the gap 19 is equal to A.

Figure 4:
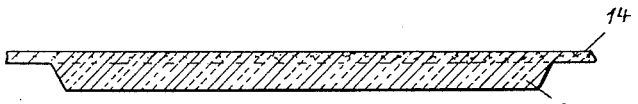
FIG. 4 is a cross-section taken along the lines IV—IV of FIG. 3.
Figure 5:
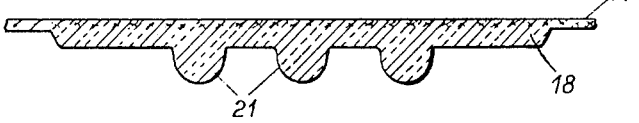
FIG. 5 is a cross-section taken along the lines V—V of FIG. 3.
Figure 6:
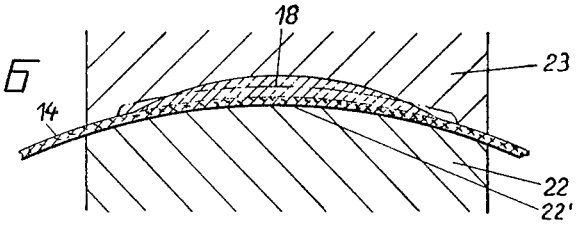
FIG. 6 is a schematic view of another embodiment of a detail shown in FIG. 3 and showing forming dies.

The stiffened area can be made up of any type of suitable material which can be glued or impregnated to the fabric in order to give it the desired result. FIG. 4 shows a typical cross-section of such a stiffened area 18. FIG. 5 shows an embodiment of the stiffened area which includes radially extending ribs 21 which further enhances the radial stiffness of the areas 18 identified as F1 and F2 in FIG. 3. The stiffened area 18 can also be made up of a convexly curved portion formed on the cover such as shown in FIG. 6. Numerals 22 and 23 represent forming dies, and the material could be plastic or other stiffening material which can be formed and adhered to the fabric.

Preferably the length II of F2 is shorter than the length I of F1 such that when the umbrella is being folded as shown in FIG. 2, the greater length of the stiffened portion F1 as represented by the numeral I force the mushroom somewhat downwardly. As also noted in FIGS. 2 and 3, when the telescopic stick and the dome ribs are being telescoped, the annular portion of the cover material A is folded outwardly about the hinged portion 19 into a mushroom shape.

The shapes of the stiffened areas 18 can be other than that shown in the drawings. For instance, the stiffened area F2 could be elliptical or oval as long as the long axis of the ellipse or oval is in the radial direction. Of course, a similar cover as described above could be applied to an umbrella frame having a quadrilateral support structure wherein the dome ribs are not hinged directly to the crown. Satisfactory mushroom forming results could also be obtained.

We claim:

1. An umbrella comprising a frame and a cover of flexible material the frame including a telescopic stick, a crown at one end of the stick, a plurality of dome ribs extending radially from the crown and each supported by a support structure, the support structure for each dome rib including at least a stretcher means hinged to a common runner slidable on the stick, the stretcher member also being hinged to the dome rib, the runner and the stretcher member being adapted to shorten the effective length of the dome ribs when the runner is moved towards the crown, the cover being supported on the dome ribs and being attached centrally to the crown and peripherally to each end of the dome rib ad at an intermediate attachment point on each dome rib, the flexible material of the cover including radially extending stiffened areas between the crown and the intermediate attachment points, the radially extending stiffened areas each having a hinged portion separating the stiffened portions into a first stiffened section and a second stiffened section in radial alignment such that when the umbrella is being collapsed, and the runner moves toward the crown the intermediate attachment points on the dome ribs will move radially towards the crown, the second stiffened portions will fold under the first stiffened portions whereby the cover portion between the intermediate points and the crown will form a spread foldable mushroom shape, the total radial length of the stiffened areas and the hinged gap between the stiffened areas being equal to the distance from the periphery of the crown to the attachment point on the dome rib when the umbrella is extended.

2. An umbrella cover as defined in claim 1, wherein the radial length of the first stiffened section is greater than the radial length of the second stiffened section in each pair such that when the cover is being folded, the spread mushroom shape will be at an acute angle to the stick inwardly of the crown.

3. An umbrella as defined in claim 1, wherein the stiffened area includes a rigid material layer adhered to the cover fabric material and a plurality of radially extending ribs are formed on the layer such that the stiffness in the radial direction will be greater.

4. An umbrella as defined in claim 1, wherein the dome ribs are telescopic and are hinged to the crown, a main runner is slidable on the stick, an auxiliary runner is slidable on the stick between the main runner and the crown, stretcher members extend from the main runner and are hinged to a geats slidable on the dome ribs, strut members are hinged to the auxiliary member and to each stretcher member, and the intermediate points of the cover material are attached to the geats by means of a thread.

5. An umbrella as defined in claim 1, wherein the total radial length of the stiffened areas and the hinged gap between the stiffened areas is equal to the distance from the crown to the intermediate point of the cover attached to the geats.

* * * * *